United States Patent [19]

Pailler

[11] 3,946,706

[45] Mar. 30, 1976

[54] ROTARY MACHINES COMPRISING FOUR CYLINDERS IN A STAR

[76] Inventor: Yves Pailler, Cieux, France

[22] Filed: June 10, 1974

[21] Appl. No.: 478,104

[30] Foreign Application Priority Data

June 14, 1973 France ..... 73.22378

[52] U.S. Cl...... 123/56 BC; 403/348; 123/197 AB

[51] Int. Cl.[2]..... F02B 75/22; F02B 75/24

[58] Field of Search..... 123/56 AC, 56 BC, 197 A, 123/197 AB; 403/348, 349, 319, 353; 74/579 E; 92/238, 255

[56] References Cited

UNITED STATES PATENTS

| | | | |
|---|---|---|---|
| 1,774,105 | 8/1930 | Neldner | 123/56 BC |
| 2,132,595 | 10/1938 | Bancroft | 123/56 AC |
| 2,366,186 | 1/1945 | Freeman | 123/56 BC |
| 3,258,992 | 7/1966 | Hittell | 123/56 BC |
| 3,517,651 | 6/1970 | Graybill | 123/56 BC |

FOREIGN PATENTS OR APPLICATIONS

| | | | |
|---|---|---|---|
| 509,982 | 11/1920 | France | 123/197 AB |

*Primary Examiner*—Charles J. Myhre
*Assistant Examiner*—William C. Anderson
*Attorney, Agent, or Firm*—Larson, Taylor & Hinds

[57] ABSTRACT

An explosion engine comprises: a rotary shaft with axis A; four cylinders 6, 7, 8, 9 in a star aligned in pairs on two axes B and C perpendicular to the axis A and to each other, but not coplanar; a first assembly of two pistons 10, 11 suitable to slide within two of the said cylinders and connected together head to tail by a first rigid cross piece 12; a second assembly of two pistons 13, 14 suitable to slide in the other two cylinders and connected together head to tail by a second rigid cross piece 15; and a mechanism with eccentrics suitable to transform the alternating slidings of these two assemblies into rotations of the shaft or conversely. On the one hand, each cross piece 12, 15 is guided for smooth sliding in two sleeves 24 solid with the casing 1 of the machine and therefore with the cylinders 6, 7, 8, 9, and on the other hand, each piston 10, 11, 13, 14 is fixed on one extremity of the corresponding cross piece by a device permitting relative transverse, but not longitudinal, displacements or wobbling of said piston relative to the said cross piece.

8 Claims, 6 Drawing Figures

ROTARY MACHINES COMPRISING FOUR CYLINDERS IN A STAR

The invention concerns rotary machines of the type of explosion engines, pumps, and compressors including a rotary shaft with axis A, four cylinders in a star, aligned in pairs along two axes B and C both perpendicular to the axis A and to each other, but not coplanar; a first assembly of two pistons suitable to slide within two of said cylinders and connected to each other head to tail by a first rigid cross piece; a second assembly of two pistons suitable to slide within the other two cylinders and connected together head to tail by a second rigid cross piece; and a mechanism suitable to transform the alternating slidings of these two assemblies into rotation of the shaft or inversely, said mechanism including two eccentrics solid with one another and out of phase by 180° relative to each other about the same journal, which is solid with the said shaft and is itself eccentric relative to this shaft, each eccentric being mounted in the central zone of one of the cross pieces in such a way as to be able to pivot within the same.

Such a rotary machine has been described in the first French Addition Certificate No. 95,879, filed on 1st Oct. 1968 and granted on 4th Oct. 1971 to French Pat. No. 1,453,504, of the Applicant, filed on 13th Aug. 1965 and granted on 16th Aug. 1966.

This rotary machine has proved very satisfactory.

The present invention proposes to improve it further in one detail as follows.

Because of the lateral forces exerted on the cross pieces by the rotation of the eccentrics, the pistons to which these cross pieces are rigidly connected have a tendency to wear laterally and thus to ovalise the cylinders within which they slide, which may well result in undesirable leaks and/or seizing.

This inconvenience is eliminated, according to the invention, by the combination of the following two arrangements:

guiding with smooth sliding of each cross piece in two sleeves solid with the casing of the machine and thus with the cylinders, mounting the pistons each on an extremity of a cross piece by means of a device allowing transverse, but not longitudinal, displacements or wobbling of the said piston relative to said cross piece.

On account of the guiding as indicated, the lateral forces which were previously contained by the piston-cylinder contacts are now exerted at the level of cross piece-sleeves, a level at which they can be much more easily contained without wear or deformation.

Such guiding is made possible by the transverse floating mounting of each piston on the corresponding cross piece; if such a possibility of flotation were not to be provided the rigorous demands for relative axial alignment of the sleeves and the corresponding cylinders would have made the construction envisaged practically impossible.

In order to improve the guiding in question, the sleeves are preferably given relatively great axial lengths, such lengths being preferably of the same order of magnitude as the travel of the pistons, such sleeves are arranged with a maximum mutual separation, in particular by hollowing out the pistons accordingly in such a way that these latter are able to cap the said sleeves in their positions "lower dead center", the heads of said pistons being relatively thin, and an anti-friction ring is advantageously interposed between each sleeve and that part of the cross piece which is surrounded by the said sleeve, which said part has the form of a cylindrical stem.

As concerns the device for fixing each cylinder on to the corresponding cross piece, so as to permit mutual transverse wobbling between the piston and the cross piece, this may advantageously include: a collar eccentric with respect to the axis of the cross piece and solid with the corresponding extremity of the same, a bayonet seating hollowed out of the face of the piston situated on the side of the cross piece, the said seating being adapted to accept the collar successively in an axial translation and in a rotation about the axis of the piston, said seating being designed in such a way as to make possible the transverse wobbling of the collar at the end of the said rotation; and means of locking the collar angularly within its seat at the end of the said rotation.

In addition to these principal features, the invention includes certain other features which are preferably employed at the same time and which will be described in more detail in the following.

In what follows we shall describe a preferred embodiment of the invention with reference to the attached drawings in a manner which is, of course, non-limiting.

FIGS. 1 and 2 of these drawings show, respectively, a transverse cut away section approximately according to I—I of FIG. 2 and an axial section according to II—II of FIG. 1 through an explosion engine designed according to the invention.

Figure 1:
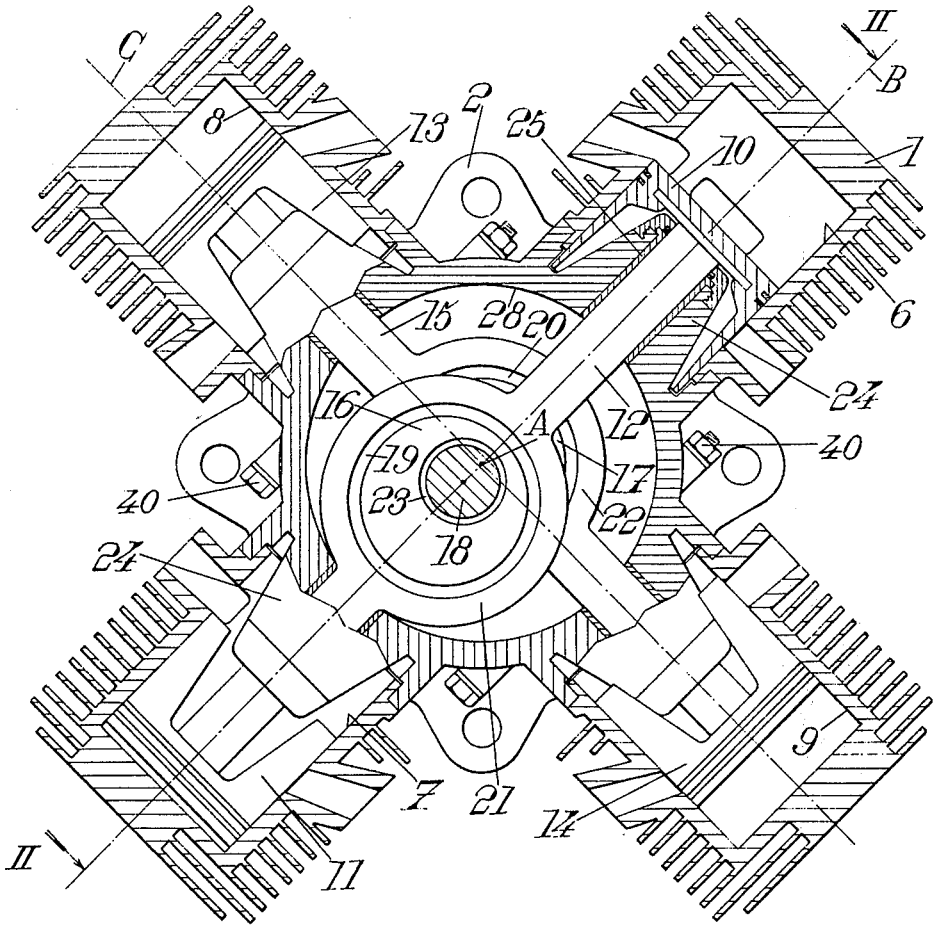
Figure 2:
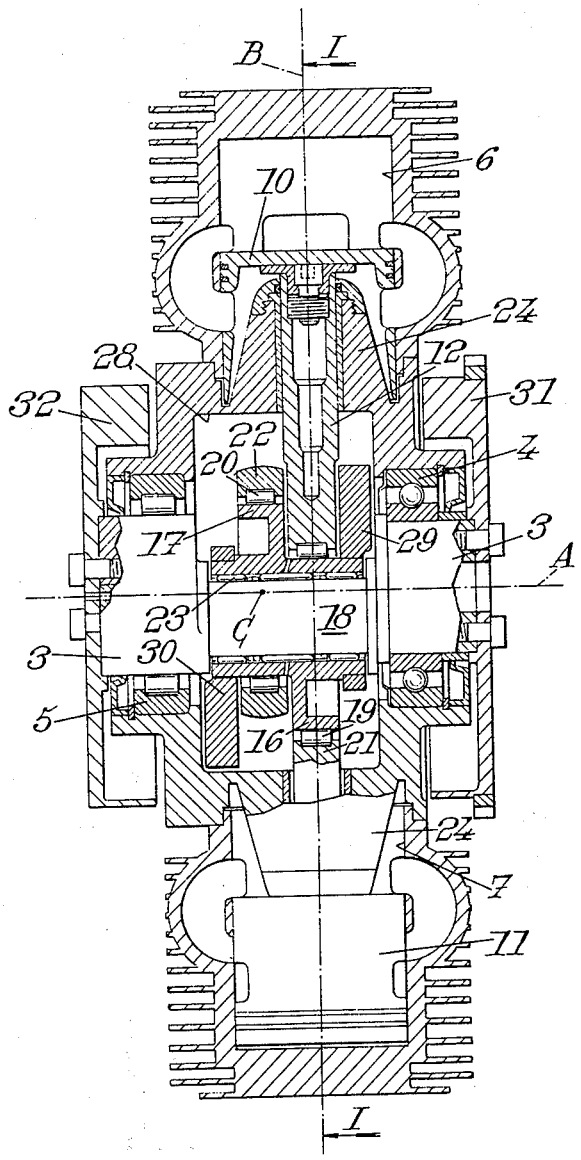

The engine illustrated here includes:

a casing or cylinder block 1 which can be fixed to the rest of the chassis by the bolting of perforated feet 2, and a shaft 3 with axis A, pivoting in two roller bearings 4 and 5 carried by the block 1.

This block itself includes four cylinders 6, 7, 8, and 9 in a star and aligned in pairs along two axes B and C, both intersecting the axis A, and both perpendicular to that axis and to each other, but not coplanar.

Two pistons 10 and 11 connected together head to tail by a first cross piece 12 slide in two of cylinders 6 and 7.

In the other two cylinders 8 and 9 there slide two pistons 13 and 14 connected together head to tail by a second cross piece 15.

A mechanism is provided to transform the alternating sliding of the two piston-cross piece assemblies into rotation of the shaft 3.

A mechanism includes two eccentrics 16 and 17, solid with each other and mutually out of phase by 180° about the same journal 18, solid with the shaft 3 and itself eccentric with respect to said shaft.

In the mode of embodiment illustrated:

each eccentric is an eccentric disc pivoting by means of a ball bearing (respectively 19, 20) in an annular cage (21, 22) which forms the central part of one of the cross pieces, the journal 18 constitutes an eccentric crank pin of the shaft 3, which is of the crank shaft type, and it is itself mounted in two eccentric discs 16, 17 in the interior of a ball bearing 23.

There are also provided:

on the one hand two rigid sleeves 24, solid with the cylinder block 1, to guide rigidly each rigid cross piece and to contain the lateral forces exerted on each cross piece by the rotation of the eccentrics, on the other hand, a system of mounting for each piston on the extremity of the corresponding cross piece which allows slight mutual displacements transversely but no mutual axial displacement.

In order that the desired guidance shall be ensured in the best possible manner, efforts are made to separate the two sleeves 24 of each pair by the maximum distance and to make each of them as long as possible.

For this purpose, in the embodiment illustrated, each piston has a head which is relatively thin and which has the general form of a bell suitable to cap the corresponding sleeve, which, on the other hand, has the form of a frustrum allowing it to penetrate deeply into the interior of the piston, and the axial length of each sleeve 24 is slightly greater than the travel of the pistons in their cylinders, the axial extremity of each sleeve which is furthest from the axis A being practically in contact with the head of the piston opposite when the latter is at its lower dead point and the axial extremity of that sleeve which is closest to the axis A being practically in contact with the cage (21 or 22) belonging to the corresponding cross piece when the piston mounted on the side of the sleeve in question is at its upper dead point.

Those parts of the cross pieces 12 and 15 which slide within the sleeves 24 are advantageously parts of stems which have the form of cylinders of revolution.

In order to facilitate sliding of these parts of stem within their guides, rings 25 of anti-friction metal with good heat resistance, and producing an effect of automatic lubrication, are preferably introduced between these elements.

These rings are advantageously mounted in an easily dismountable manner in the sleeves in the following way: at one of the extremities of each ring an external flange 25*a* (FIG. 3) is provided, the said ring is introduced axially into the corresponding sleeve in the direction of the axis A until its flange 25*a* butts against the opposite edge of the sleeve, the assembly is then locked by screwing a threaded cap 26 on to the end of the sleeve, which is correspondingly threaded, with, if necessary, a sealing ring 27 interposed.

In order to accept the cages 21 and 22 and their contents — cages which are in practice displaced relative to each other in the direction of the axis A by the thickness of a cross piece, a thickness which is generally between 10 and 30 mm — a chamber 28 with the general form of a flattened cylinder of revolution about axis A is provided at the centre of the cylinder block.

FIG. 2 also shows:

on the one hand eccentric equilibriating counterweights 29 and 30 arranged inside the chamber 28, said counterweights being in one piece with the eccentric discs 16 and 17 so as to compensate for the vibratory forces which said discs and their attached devices exercise radially on the journal 18, and eccentric counterweights 31 and 32 solid with the shaft 3 to compensate the vibratory forces exerted on said shaft as a result of the eccentricity of the journal 18 and of the assembly coupled with said journal.

We shall now describe in more detail a preferred mode of embodiment of the mounting system, with transverse wobbling, of each piston on the corresponding extremity of the stem, with reference to FIGS. 3 to 6.

The extremity of the stem 12 under consideration is made solid with a collar 33, eccentric with respect to the axis of said stem, and a bayonet seating 34, suitable to accept the collar 33 successively in translation parallel to the axis of the stem and in rotation about said axis, is hollowed out of the face of the piston 10 in question which is situated at the cross piece side.

This seating is provided in such a way as to enclose the collar in the axial direction from edge to edge and to make possible its transverse wobbling at the end of the above-mentioned rotation, the amplitude of the said transverse wobbling corresponding to a play J.

This clearance J is chosen in such a way that the magnitude of J/2 remains greater than the maximum departure from coaxial alignment expected between the respective axes of a cylinder and the sleeve surrounded by the said cylinder.

Means for angularly locking the collar in its seating at the end of the above-mentioned rotation are also provided.

These means are here constituted by a finger 35 solid with the piston and a slot 36 hollowed out radially in the collar which is suitable to span the said finger from edge to edge.

The maximum spanning height of the finger by the slot is equal to the above-mentioned clearance J.

Figure 3:
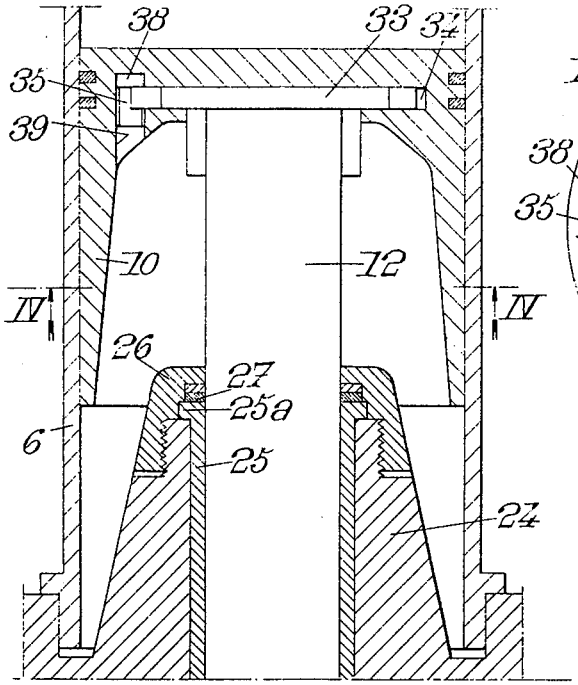
FIGS. 3 and 4 show, respectively, in axial section according to III—III FIG. 4 and in transverse section according to IV—IV FIG. 3, a detail of the engine.
Figure 5:
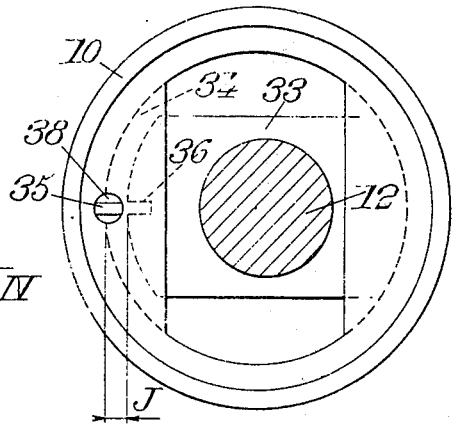
FIG. 5 is a view analogous to part of FIG. 4, showing the relative positions of certain of the elements of the engine during assembly.
Figure 4:
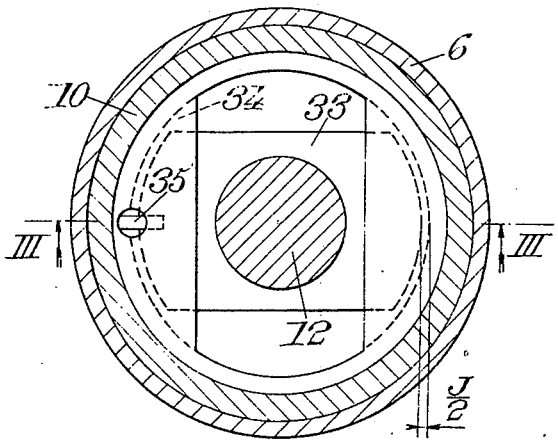
Figure 6:
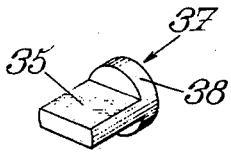
FIG. 6 illustrates an enlarged perspective of a small part of this engine.

In the mode of embodiment illustrated the finger 35 for angular locking is constituted by the foot, with flattened rectangular section, of a pawn 37 with a flat head 38, said pawn being lodged in a recess 39 hollowed out in the face of the piston at the cross piece side. This recess is designed in such a way that the pawn 37 remains imprisoned in it after the collar 33 has been put in position in its seating 34 and after its slot 36 has spanned the finger 35: in fact, in such a position, the head 38 of the pawn butts axially against the edges of said slot, as can be seen in FIGS. 3 and 4.

This type of locking has the following advantages: it allows the collar to be mounted in its seating and thus the piston mounted on the stem, without the use of any tool such as a screwdriver or the like, and it ensures a rigorous solidification of the piston with the stem in the axial direction while allowing its transverse wobbling which makes it possible to compensate for possible lack of axial alignment of the respective axes of, on the one hand, the sleeve 24 and, on the other hand, the piston 10, i.e. the cylinder 6 within which the latter is mounted to slide.

In these conditions assembly of the engine is particularly simple.

The various bearing and eccentric devices, including the cross pieces 12 and 15, are first mounted on the shaft 3 and its crank pin 18.

The cylinder block 1 is then closed on this assembly, the said cylinder block being advantageously constituted by two half shells pressed against one another by screwing up systems of screw bolts 40.

The anti-friction rings 25 are then put in place by introducing them into the sleeves 24 from the outside and they are then locked by screwing the caps 26.

Then each of the four pistons is mounted on the extremity of the corresponding stem (12 or 15) by means of a bayonet displacement followed by light transverse pressure (FIG. 5) until the slot 36 and the finger 35 are opposite to each other, after which the piston is recentered on the stem (FIG. 4).

It is then sufficient to assemble the four cylinders o the block 1 in such a way that each of them caps one of the pistons; after this final operation each piston is exactly centered within its cylinder by means, if necessary, of a small transverse displacement with respect to the corresponding stem, a displacement whose magnitude is less than J/2.

It should be noted that the centering in question can be made, not only in the transverse direction which joins the finger 35 to the axis of the corresponding piston, but equally well in a direction perpendicular to this since the play J permits, not only transverse translation of the collar 33 within its seat 34, but also slight transverse oscillations of said collar about the finger 35.

Preferably, each of the piston-cylinder assemblies operates as a two-stroke engine with precompression below the piston in a manner such that four explosions are observed for each complete revolution of the shaft 3, which ensures a high cyclic regularity.

After which, whatever the embodiment adopted, there is produced an engine with eccentrics which does not include any tie rod-crank system, which allows precise equilibration resulting in the suppression of vibrations; in addition, since each piston is subjected only to axial and non-oblique forces, the life time and robustness of this engine are remarkably high.

As is obvious, and as can also be concluded from the foregoing description, the invention is not limited to those of its applications and embodiments which have been more particularly discussed; on the contrary, it includes all variants, notably:

those in which one, two or three pistons are replaced by the same number of equilibriated guides, the motor then becoming, respectively, a three cylinder, a two cylinder, or a mono-cylinder engine, those in which the rotary engine is not a two-stroke engine but is an engine of another type, or even a compressor or a pump, in which case the shaft of the machine becomes the driver instead of being driven, or again, those in which several machines of the same type or of analogous types are mounted in line on the same shaft.

I claim:

1. Rotary machine of the explosion engine type, pumps, or compressors including: a rotary shaft with axis A; four cylinders in a star aligned in pairs on two axes B and C perpendicular to the axis A and to each other, axis B lying in one plane and axis C being in a further separate plane; a first assembly of two pistons suitable to slide within two of the said cylinders and connected together head to tail by a first rigid cross piece; a second assembly of two pistons suitable to slide within the other two cylinders and connected together head to tail by a second rigid cross piece; and a mechanism suitable to transform the alternating slidings of these two assemblies into rotation of the shaft or conversely, said mechanism including two eccentrics solid with each other and mutually out of phase by 180° around the same journal which is solid with the said shaft and is itself eccentric with respect to the shaft, each eccentric being mounted in the central zone of one of the cross pieces in such a way as to be able to pivot within it, wherein on the one hand, each cross piece is guided for smooth sliding in two sleeves which are integral with the casing of the machine and therefore with the cylinders and that, on the other hand, each piston is fixed on one extremity of the corresponding cross piece by a device permitting relative transverse, but not longitudinal, displacements of said piston relative to the said cross piece.

2. Rotary machine according to claim 1, wherein the axial length of each sleeve is greater than the travel of the pistons within their cylinders.

3. Rotary machine according to claim 1, wherein an anti-friction ring is interposed between each sleeve and that part of the cross piece which is surrounded by said sleeve, said part of the cross piece having the form of a cylindrical stem.

4. Rotary machine according to claim 1, wherein the device for fixing each piston to the corresponding cross piece includes: a collar eccentric with respect to the axis of the cross piece and solid with the corresponding extremity of the latter; a bayonet seating hollowed out of the face of the piston on the cross piece side, the said seating being suitable to accept the collar successively in axial translation and in rotation about the axis of the piston, the said seating being designed in such a way as to make possible transverse displacements of the collar at the end of the said rotation; and means for locking the collar angularly in its seating at the end of the said rotation.

5. Rotary machine according to claim 4, wherein the means of locking include a finger solid with the piston and a groove made in the lateral edge of the collar and suitable to span the finger.

6. Rotary machine according to claim 5, wherein the maximum possible height through which the finger is spanned by the slot is equal to the maximum play (J) in the transverse displacements of the collar in its seating in the angularly locked position.

7. Rotary machine according to claim 5, wherein the finger for angular locking is the foot of flattened rectangular section of a pawn with a flat head which is mounted in a recess formed in the face of the piston situated on the cross piece side, the said recess being provided in a manner such that the said pawn remains imprisoned within it after the collar has been mounted in its seating, by reason of the axial abutment of the head of said pawn against the said collar.

8. Rotary machine according to claim 1 wherein said transverse displacements of each piston are multidirectional in radial planes relative to the longitudinal axis of the corresponding cross piece.

* * * * *